United States Patent [19]

Schippers et al.

[11] 4,175,712

[45] Nov. 27, 1979

[54] CHUCKING SPINDLE FOR THE RECEPTION OF A BOBBIN CARRIER

[75] Inventors: Heinz Schippers; Erich Lenk, both of Remscheid, Fed. Rep. of Germany

[73] Assignee: Barmag Barmer Maschinenfabrik Ag, Remscheid-Lennep, Fed. Rep. of Germany

[21] Appl. No.: 902,386

[22] Filed: May 3, 1978

[30] Foreign Application Priority Data

May 4, 1977 [DE] Fed. Rep. of Germany ..... 2719853
Apr. 17, 1978 [CH] Switzerland ..... 4087/78

[51] Int. Cl.[2] ..... B65H 54/54
[52] U.S. Cl. ..... 242/46.4
[58] Field of Search ..... 242/46.4, 46.2, 46.3, 242/46.5, 46.6, 72 R, 72 B, 72.1, 68.1, 68.2, 68.3; 279/2, 4, 1 B, 1 T

[56] References Cited

U.S. PATENT DOCUMENTS

| | | | |
|---|---|---|---|
| 683,865 | 10/1901 | Skofsrud | 242/72 R UX |
| 2,734,691 | 2/1956 | Godat | 242/72 R |
| 3,462,092 | 8/1969 | Mullins | 242/46.4 |
| 3,494,565 | 2/1970 | Mullins | 242/46.4 |
| 3,495,781 | 2/1970 | Graf et al. | 242/46.4 |
| 3,813,051 | 5/1974 | Miller | 242/46.4 |
| 3,815,836 | 6/1974 | Munnekehoff et al. | 242/46.4 |
| 3,833,179 | 9/1974 | Maurer | 242/46.4 |
| 3,923,261 | 12/1975 | Isoard et al. | 242/46.2 |
| 3,974,973 | 8/1976 | Lenk et al. | 242/41 |
| 4,022,392 | 5/1977 | Thomas, Jr. et al. | 242/46.4 X |

FOREIGN PATENT DOCUMENTS

| | | | |
|---|---|---|---|
| 1262718 | 3/1968 | Fed. Rep. of Germany | 242/46.4 |
| 1009466 | 11/1965 | United Kingdom | 242/72 R |

*Primary Examiner*—Stanley N. Gilreath
*Attorney, Agent, or Firm*—John H. Shurtleff

[57] ABSTRACT

An improved chucking spindle arrangement for use in a thread winding device wherein a removable bobbin carrier is slipped about the chucking spindle. The improvement comprises an actuating means for moving the bobbin carrier clamping elements, which are axially distributed about the outer circumference of the chucking spindle, into their retracted or released position when it is desired to change the bobbin carrier. In the preferred embodiment, the actuating means is a compressed air operated annular piston ring which is slidably mounted about the chucking spindle and which engages the bobbin carrier clamping elements which are mounted in common cages. These clamping elements may operate according to the so-called "freewheeling" principle which assures the self-locking of the bobbin carrier. A unique mechanical arrangement for transforming the axial thrust component of the actuating means into a rotary movement of the clamping elements is also disclosed along with various arrangements for delivering the compressed air supply to the actuating means.

12 Claims, 4 Drawing Figures

CHUCKING SPINDLE FOR THE RECEPTION OF A BOBBIN CARRIER

INTRODUCTION

The present invention relates generally to a chucking spindle arrangement for use in a thread winding device where threads, yarns, filaments or the like are wound onto a bobbin or core carrier sleeve. In particular, the present invention relates to an improved chucking spindle which forms a part of the winding shaft on such a device which is expandable in order to secure the bobbin carrier thereto.

BACKGROUND OF THE INVENTION

A number of different chucking spindle constructions are known for securely locking bobbin carriers onto the carrying arm or winding shaft of thread winding machines. For example, so-called bar tension chucks have a wide enlargement or an axially slidable cone mounted on the chucking shaft which cooperates with respect to a counter-cone arrangement. In securing the bobbin carrier to the chucking device, the counter-cone is moved radially outward by shifting the axially slidable cone thereby gripping the bobbin carrier thereabout.

However, such cone-type chucking spindles have the disadvantage that a slide fit is required between the chuck shaft and the cone. This slide fit is of a very complicated design since otherwise, after a relatively short operational period, jamming and rusting inside the slide fit would occur, thereby taking the entire chucking spindle out of operation.

In order to overcome these drawbacks found with cone-type chucking spindles, clamping elements that operate according to the so-called "freewheeling" or coasting principle were developed. An example of such a chucking spindle is disclosed in U.S. Pat. No. 3,815,836 to Munnekehoff et al. Such chucking spindles are especially advantageous in that the clamping elements thereof are self-locking so that even with the introduction of high torsional or braking forces the bobbins will remain securely clamped.

However, in spite of the mechanical advantages of such "freewheeling" chucking spindles, several operational difficulties have been encountered in their use. Since the mounting and removal of the bobbin carriers takes place by means of turning them by hand in order to disengage the clamping elements of the device while simultaneously moving the carriers axially on or off of the chucking shaft, if several bobbin carriers are arranged in axial succession on a single chucking spindle, the rearmost bobbin carrier must be slid over all of the front clamping zones in order to mount or remove it. Hence, with great care the bobbin carrier must be constantly rotated by hand from the front to back of the chuck shaft as it is slid thereon and this process must be again repeated when it is removed.

Hence, the chucking spindle of the present invention was developed to take advantage of the desirable self-locking features of the known "freewheeling" spindles, while at the same time avoiding all of the above-described disadvantages of conventional chucking spindles.

BRIEF DESCRIPTION OF THE INVENTION

The present invention eliminates the disadvantages found with conventional chucking spindle arrangements by providing an actuating means for moving the clamping elements mounted on the chucking spindle into their retracted position when it is desired to change the bobbin carrier. Since this actuating means is formed as a part of the chucking spindle, no external aids are needed to slide the bobbin carrier on or off of the device and it is immaterial whether such sliding of the bobbin carrier is carried out manually or by machine. Furthermore, since the working elements of the actuating means are integrated as a part of the rotating chucking spindle, no imbalance problems can arise during and after operation of the device.

The arrangement of the present invention may also be conveniently adapted for use with chucking spindles with clamping elements that operate according to the "freewheeling" or self-locking principle. Such an embodiment is especially desirable in that while all of the advantages of the "freewheeling" principle are utilized, it is avoided that the time-consuming and impractical steady rotary and axial movement of the bobbin carrier about the chucking spindle must be accomplished in order to remove or slide on the bobbin carrier, particularly where several bobbin carriers are used on one long chucking spindle. As has been noted, since the clamping force of these elements is unaffected by the present invention, their desirable independent operation according to the "freewheeling" principle is fully preserved.

Even if it is not desired to construct the chucking spindle according to the "freewheeling" principle, it is possible to utilize the present invention with other types of chucking spindles. For example, kidney-shaped clamping elements which are very simple to produce may be used. The clamping force exerted by such elements may be made dependent upon a spring force that will allow automatic adjustment for different forms and sizes of the bobbin carrier.

A lug formed on the arcuate slide surface of the clamping elements engages the actuating means and also serves as a stop both in the extended direction of the elements when no bobbin carrier is placed about the chucking spindle and in the fully retracted position of the clamping elements. Hence, in this simple manner the functioning of the clamping elements is always assured.

Since in all embodiments the clamping elements immediately abut the chucking spindle, it may be formed entirely in a cylindrical shape. Furthermore, in contrast to bar tension-type chucks, fewer elements are moved during the tensioning and releasing of the clamping elements, thereby making the production of such chucking spindles more economical and their security in operation greater.

A substantial facilitation in the assembling and a further increase in the functional security of the device is provided by arranging the clamping elements of the chucking spindle in a common cage. In this manner it is assured that all of the clamping elements of a clamping place are operated simultaneously and uniformly, thereby achieving a coaxial relationship between the bobbin carrier and chucking spindle.

By providing a winding groove which cooperates with the actuating means, the thrust component of the actuating means which is axially parallel to the axis of the chucking spindle may be transformed into a rotary movement with respect to said cage. This construction has the advantage that only one translational movement is performed by the actuating means and the necessary rotary movement is achieved through the unique construction of the actuating means itself.

It has been found that connecting the cage elements to the actuating means, which may be an annular piston ring slidably mounted about the chucking spindle, by means of axially parallel guide elements and forming the winding groove in the inner circumference of the piston ring for cooperation with a guide ball fixed to the outer circumference of the chucking spindle has proven to be successful as a manufacturing technique for transforming the axial movement of the piston ring into a rotary movement of the clamping elements.

The actuating means may be operated electrically, hydraulically, pneumatically or by similar suitable drive techniques. In the preferred embodiments discussed below, a pneumatically operated actuating means is utilized. In order to simplify the construction of the device, a torsion spring may be utilized to create a force which normally brings the clamping elements into their extended position. Hence, it is necessary that the actuating means exert thrust in only one direction of travel in order to bring the clamping elements into their released position.

A unique means is also presented for sealing the ends of the compressed air-carrying annular gap between the chucking spindle and carrying arm is also disclosed. In a preferred embodiment, this sealing means consists of an annular piston ring mounted for axial movement in the machine frame which is actuated by the compressed air supply prior to the air being supplied to the actuating means for the clamping elements. This arrangement has the advantage that no wear of the sealing elements is experienced during operation of the thread winding machine since it is only engaged when the bobbin carrier and chucking spindle are at a standstill.

A choke may be placed in the compressed air feed line in order to create a time lag in the air pressure build up between the resulting subdivisions of the line. In this manner the sealing elements may be operated first before air is supplied to the actuating means for the clamping elements. Hence, no air leakage will occur so that all of the clamping elements of the chucking spindle will operate simultaneously.

As a final point, in order to prevent the bearings which support the chucking spindle upon the carrying arm from having their lubricant forced out when compressed air is introduced to release the clamping elements, the air is simultaneously supplied at substantially equal pressure from both sides of the bearings. Hence, the compressed air does not flow through the bearings in order to reach the individual actuating means for the clamping elements and no lubricant is thereby dragged away. In addition, no special sealing of the bearings from the compressed air is necessary.

DESCRIPTION OF THE PREFERRED EMBODIMENT

Figure 1:
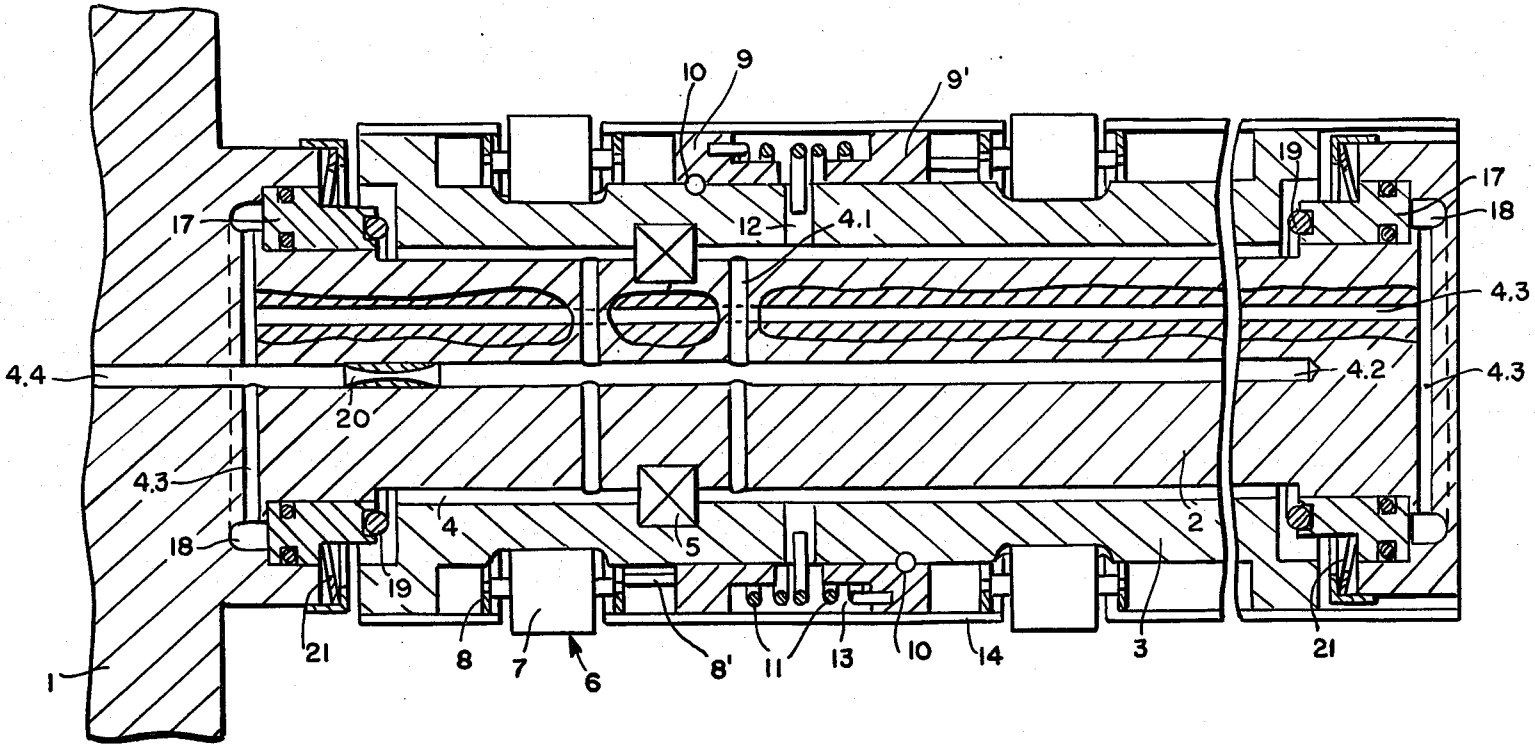
FIG. 1 is a schematic view in axial cross-section of a chucking spindle arrangement illustrating a particular embodiment of the present invention.

FIG. 1 illustrates a schematic view through the axis of a chucking spindle arrangement constructed in accordance with an embodiment of the present invention in which only the machine side and the front ends of the device are represented.

Secured to machine frame 1 is a carrying arm 2 which extends outwardly therefrom. Chucking spindle 3 is turnably fastened about arm 2 by means of bearing bodies 5.

Figure 3:
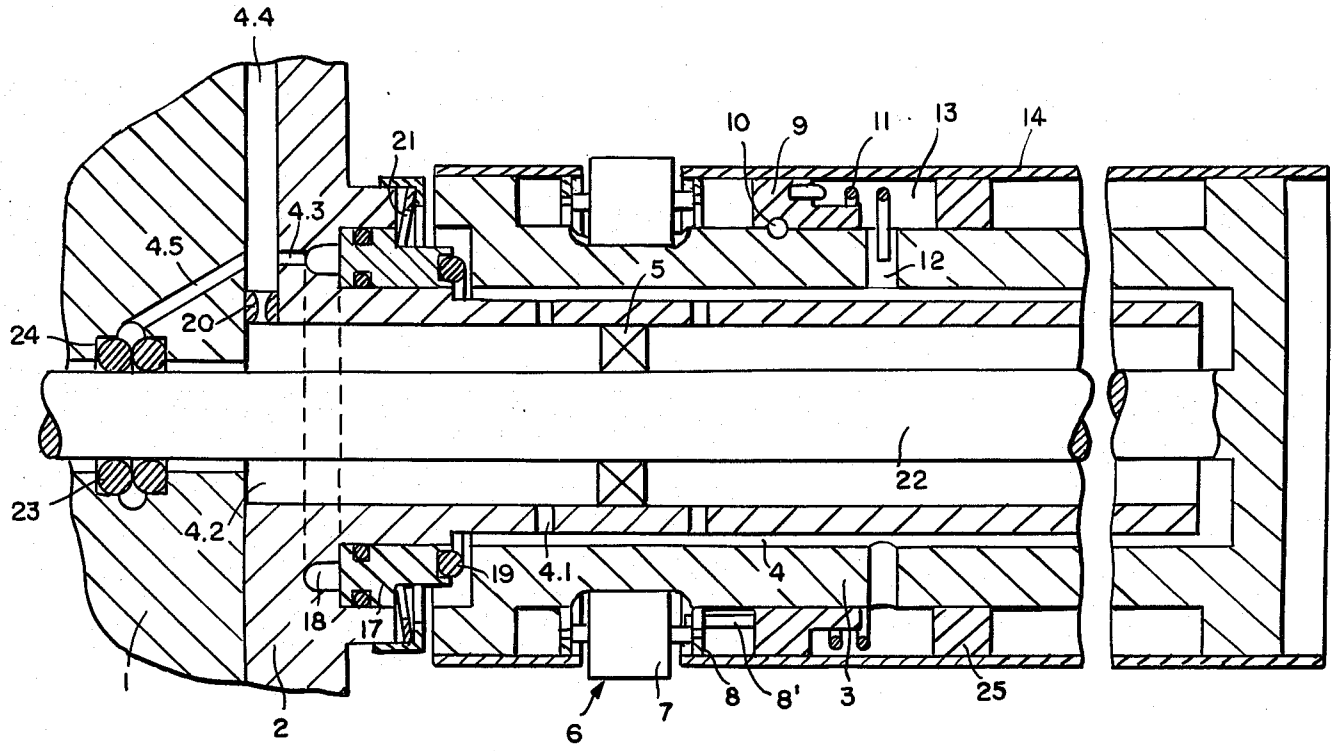
FIGS. 3 and 4 are schematic views in axial cross-section of alternate embodiments of the chucking spindle arrangement shown in FIG. 1.

It should be noted that the chucking spindle 3 shown in this particular embodiment is not directly driven itself. Rather, an external drive or contact roller (not shown) engages the circumference of a bobbin or bobbin carrier (also not shown) which is secured to the chucking spindle. However, as is illustrated in FIG. 3, it is also possible for the chucking spindle itself to be directly driven by an appropriate internal drive means.

Between carrying arm 2 and chucking spindle 3 there is formed an annular gap 4 which extends over substantially the entire length therebetween. Radially arranged connecting channels 4.1 connect annular gap 4 with distributor channel 4.2. In a further preferred development of the present invention, connecting channels 4.1 are arranged on either side of bearing bodies 5 in order to insure that the lubricant contained in these bearings will not be forced from therein by a one-sided or uneven air flow being created in annular gap 4.

At several axially separated locations about the circumference of chucking spindle 3, there are arranged clamping places 6. Since it is at these clamping places that the bobbin carrier or carriers (not shown) utilized with the spindle arrangement are engaged, their number and location will be determined by the number of bobbin carriers used.

Clamping places 6 consist of cylindrical rolls 7 which are held in a cage 8 which allows the radial play of the rolls therein. In this connection, the circumference of chucking spindle 3 is formed in a sawtooth manner in the region of clamping places 6 so that the clamping operation can operate according to the "freewheeling" principle. That is, by rotating cage 8 through a certain angular range, rolls 7 are moved outwardly along a bevel so that they achieve a greater radius with respect to the axis of the chucking spindle, thereby clamping the bobbin carrier in place. Likewise, by turning cage 8 in the opposite direction, rolls 7 will move inwardly along the bevel so that they will lie on a smaller radius, thereby releasing the bobbin carrier. This so-called "freewheeling" principle is illustrated in detail in the above-mentioned U.S. Pat. 3,815,836, the disclosure of which is incorporated by reference herein.

Figure 2:
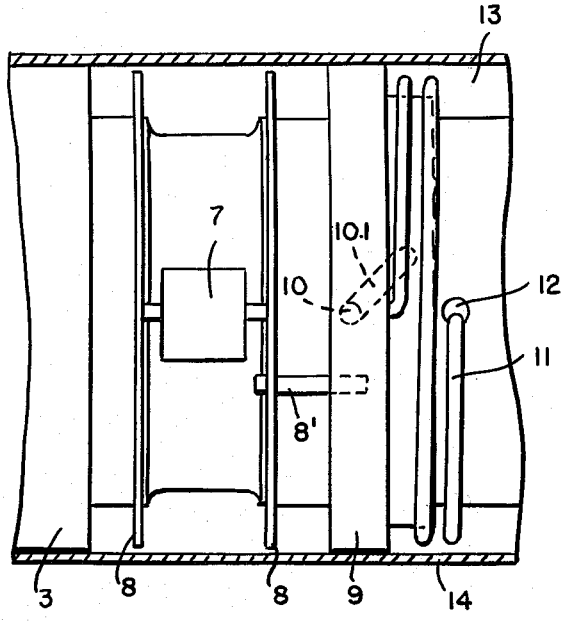
FIG. 2 is a top plan view of a portion of the apparatus shown in FIG. 1.

Referring now also to FIG. 2, on one side of cage 8 there is engaged by means of a linking pin 8' a cylindrical, annularly formed piston 9. Piston 9 is guided by guide elements 10 within a winding groove 10.1 which is formed at an angle along the circumference of chucking spindle 3. By means of a torsion spring 11, the end of which is attached to annular piston 9, the elements contained in clamping place 6 are held in the clamping position. The inclination and angular direction of winding groove 10.1 is laid out in such a manner that the annular piston 9 operates the elements of clamping place 6 against the force of torsion spring 11 in its normal or released, non-clamping direction with respect to the bobbin carrier. The bore 12 into which the other end of torsion spring 11 is fastened to chucking spindle 3 serves also as the connecting channel between annular gap 4 and spring space 13.

Spring space 13, which in the sense of the present invention is utilized as a cylinder chamber for the drive of annular piston 9, is radially enclosed and sealed by mantle sleeve 14 which consists of individual sections whose total length corresponds to that of the chucking spindle 3. These individual sections of mantle sleeve 14 are formed such that rolls 7 can be turned unhampered between them. Spring space 13 is preferably bounded in the axial direction by a further annular piston 9'. If this arrangement cannot be achieved due to the distance between individual clamping places 6 being too great, a fixed ring 25 may be used to bound spring space 13 such as is shown in FIG. 3.

On the machine side and front ends of chucking spindle 3, annular space 4 is bounded by further annular pistons 17 that are arranged for movement in machine frame 1 and the end of carrying arm 2 respectively. On the front end of each annular piston 17 is fitted an O-ring 19 which abuts against clamping mandrel 3. Annular cylinder spaces 18 are utilized to supply a pressure medium to power annular pistons 17. These cylinder spaces connect with bore 4.3 of central channel 4.4 for this purpose. Annular pistons 17 are held in their retracted starting position by means of plate springs 21. A choke 20 is utilized to divide feed channel 4.4 from distributor channel 4.2.

FIG. 2 illustrates a plan view of a portion of the chucking spindle 3 in which the outer mantle sleeve covering 14 has been removed in the vicosity of clamping places 6. In this cutaway view it is visible how annular piston 9 is guided by guide element 10 within winding groove 10.1 and how torsion spring 11 is arranged and secured thereto. As has been described above, roll 7 is turnably borne within cage 8 which is turned over an axially movable carry-along member by the action of annular piston 9.

The functioning of the device will now be explained by reference to FIGS. 1 and 2. By means of central channel 4.4, distributor channel 4.2 is connected to a pressure medium source such as an air compressor (not shown in detail). If a new bobbin carrier is to be slipped on chucking spindle 3 or a wound bobbin carrier is to be removed therefrom after winding, this operation can only take place with the clamping bobbin at a standstill. During the winding operation, clamping elements 6 are held in the engaged position due to the lagging of the chucking spindle 3 with respect to the bobbin carrier. Hence, only during the releasing or slipping on of a bobbin carrier is it necessary to apply the pressure medium.

In order to bring rolls 7 into the released position against the action of torsion spring 11 which normally holds them in the engaged position, compressed air or any other suitable pressure medium is conducted through feed channel 4.4. By reason of the operation of choke 20, pressure first builds up in cylinder spaces 18 at both ends of the chucking spindle. Hence, annular pistons 17 with their O-rings 19 will be extended to seal gap 4 between carrying arm 2 and chucking spindle 3 at each of its ends.

After this sealing operation, distributor channel 4.2 and connecting bore 4.1 will likewise build up air pressure therein. Since this air pressure builds up equally on both sides of bearings 5, it is insured that the lubrication will not be forced from within these bearings. Furthermore, it is possible to add lubricant to the compressed air utilized with this system thereby simultaneously lubricating these bearings. This type of lubrication is highly advantageous since the bobbin carrier will be changed before and after each winding operation.

At this point, the compressed air now present in gap 4 will pass through bores 12 into cylinder spaces 13, thereby moving and turning annular pistons 9 within winding grooves 10.1 by means of guide elements 10. In this manner, rolls 7 are moved counter to the force of torsion spring 11 in such a way that they roll down sawtooth offsets, thereby decreasing their outer diameter with respect to the axis of the chucking spindle and freeing the bobbin carrier.

As long as compressed air is applied to distributor channel 4.2, rolls 7 will be maintained in the released position. However, when a new bobbin carrier is slipped on chucking spindle 3, the compressed air feed is interrupted thereby returning rolls 7 to their clamping position. This occurs because annular pistons 17 will be retracted into their normal non-sealing position by the action of springs 21 so that annular space 4 will once again be open at its ends. Hence, the pressure built up in distributor channel 4.2, connecting bores 4.1 as well as cylinder spaces 13 will be relieved thereby allowing rolls 7 to be turned by torsion spring 11 back into their normal, clamping position.

Turning now to FIG. 3, there is schematically represented a chucking spindle that has a central drive mechanism. This central drive arrangement may be used either to drive the entire bobbin winding operation or only for the breaking of the rotating chucking spindle. In the latter case, the chucking spindle will be driven by an external drive roller as has been explained in connection with the embodiment shown in FIG. 1.

By contrast with the chucking spindle shown in FIG. 1, in this embodiment the chucking spindle 3 is connected at its face side away from the machine frame 1 to the drive shaft 22 which is centrally arranged within carrying arm 2. In this manner, the front annular piston 17 may be eliminated and the bearings 5 will be arranged between the drive shaft 22 and carrying arm 2 within distributor channel 4.2.

Since it is necessary with this arrangement to seal the drive shaft 22 within the machine frame 1 upon the introduction of a pressure medium into distributor channel 4.2, sealing elements 23 consisting of two O-rings arranged in an annular groove 24 formed about drive shaft 22 are utilized for this purpose. Annular groove 24 is also connected by means of one or more bores 4.5 with feed channel 4.4.

An alternate arrangement of cylinder space 13 is also illustrated in the embodiment of FIG. 3. Since individual clamping places 6 are separated by great axial distances in this particular embodiment, the cylinder spaces 13 are no longer bounded in the axial direction by corresponding annular pistons. Rather, cylinder space 13 is bounded at one axial end by an annular piston 9 and at the other end by a sleeve 25 which is fixed to the chucking spindle 3. It is possible that one sleeve 25 bound two adjacent cylinder spaces, although it may be desirable for each individual cylinder space to be bounded by a sleeve of its own. The space remaining between two of such sleeves would then be unused.

The construction and function of the individual clamping places 6 shown in FIG. 3 are the same as described above in connection with FIGS. 1 and 2. If rolls 7 are to be rotated about chucking spindle 3 into the released position for the bobbin carrier, then annular space 4 and distributor channel 4.2 must be sealed at their ends. Due to the action of choke 20, the compressed air flowing into feed channel 4.4 passes first into bore 4.3 which connects with cylinder space 18 at the machine frame side of the chucking spindle and bore 4.5 which connects with the sealing elements 23 of drive shaft 22. In this manner, annular piston 17 having O-ring 19 fitted to its front side will seal off annular space 4 and the compressed air will deform sealing elements 23 about drive shaft 22 thereby closing the gap which normally exists therebetween. Due to the design of annular groove 24, it is not possible for sealing elements 23 to be deformed in a direction other than about drive shaft 22.

At this point, the compressed air will then pass through distributor channel 4.2, connecting channels 4.1, annular space 4 and bores 12 in order to build air pressure in cylinder spaces 13 which drives annular pistons 9. As was described in detail above, rolls 7 will be moved into their released position by reason of piston 9 rotating about winding groove 10.1 by means of guide element 10.

After the bobbin change is completed, rolls 7 are brought back into their clamping position by disconnecting the compressed air supply. Once this is done the deformation of sealing elements 23 will be cancelled and piston 17 will be returned to its normal position by spring 21, thereby releasing the air pressure built up in cylinder spaces 13 and allowing torsion spring 11 to return rolls 7 back to their normal clamping position.

It should also be noted that spring 11 may be omitted in both the embodiments shown in FIGS. 1 and 3 if desired since the normal torque and centrifugal forces created when the rotation of the chucking spindle is begun will insure the secure clamping of the bobbin carrier by rolls 7 in operation. However, if no clamping elements are used which operated according to the "freewheeling principle," then alternatively the embodiment described in FIG. 4 may be utilized.

Figure 4:
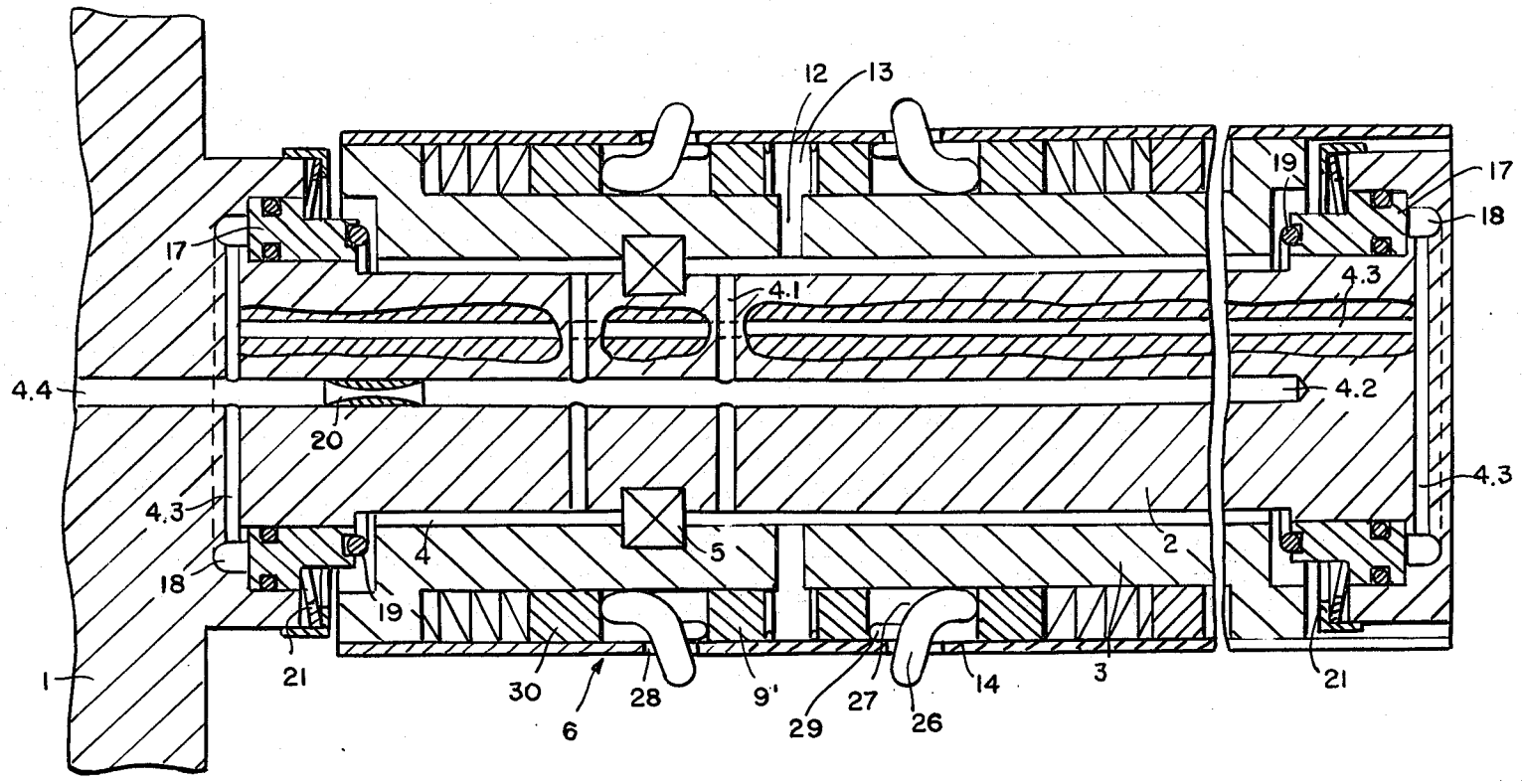

As shown in FIG. 4, carrying arm 2, air supply system 4.1, 4.2, 4.3 and 4.4 as well as pistons 17 which seal the ends of annular gap 4 are identical with those corresponding elements represented in FIG. 1. In as much as the functioning of these elements is also identical, they have been given the same reference numbers in FIG. 4 and their description will be dispensed with.

However, in contrast with the clamping system shown in FIGS. 1, 2 and 3, the clamping elements used in FIG. 4 are tensionable by spring force and relaxed by pneumatic means.

Clamping elements 26 are essentially kidney-shaped and present a sickel-shaped sliding surface 27. These clamping elements lie with sliding surface 27 resting on the chucking spindle 3 and have their free ends projecting through openings 28 formed in mantle sleeve 14. The other end of clamping elements 26 engage a spring-tensioned freely movable ring 30 which holds these elements in the clamping position shown in FIG. 4. Ring 30 is common to each of the clamping elements 26 at clamping places 6.

A lug 29 is arranged on slide surface 27, the nose of which contacts annular piston 9'. Annular piston 9' is designed to move between mantle sleeve 14 and chucking spindle 3. It also is common to all of the clamping elements of clamping places 6. The face of annular piston 9' away from lug 29 is held against axial movement beyond a desired point by a snap ring fitted in the chucking spindle 3 or mantle sleeve 14.

Similar to the embodiments described in reference to FIGS. 1 and 3, in order to retract clamping elements 26 so as to disengage the bobbin carrier (not shown), compressed air is conducted through feed channel 4.4, connector channel 4.1, annular gap 4 and bores 12 into cylinder space 13. In this manner annular piston 9' is moved axially against lug 29 which forces the clamping elements 26 against the spring force of ring 30 in such a way that they slide on their sliding surface 27 on the circumference of chucking spindle 3. Therefore, due to this sliding movement clamping elements 26 will more or less execute a rotary movement about their central axis so that their free end will be moved radially inward through mantle openings 28. In order to prevent clamping elements 26 from completely withdrawing in openings 28 and possibly becoming jammed therein, lug 29 is formed in such a manner that it will come to rest against the surface of chucking mandrel 3 prior to this occurrence, thereby preventing the further withdrawal of the clamping elements 26, the bobbin carrier will be released therefrom and can then be drawn off of the chucking spindle.

When the compressed air supply is disconnected from the arrangement, the spring of ring 30 will again press the clamping elements 26 radially outward of clamping places 6. If no bobbin carrier happens to be placed over the chucking spindle at this point, lug 29 also serves to prevent the clamping elements from falling entirely through openings 28 and out of the chuck. Furthermore, in order to achieve a uniform outward movement of the clamping elements, it is desirable to distribute several engaging springs about the circumference of each ring 30.

It is also noted that it is possible to form ring 30 and piston 9' as one element in which an opening is made for the reception of the clamping elements 26. Such a construction is represented by the clamping elements shown on the right-hand side of FIG. 4. In this embodiment, ring 30 and annular piston 9' are formed together to create a cage area for the reception of clamping elements 26, which at the same time functions as a thrust element for the drive arrangement. Hence, in this manner the elements necessary for the operation of the clamping elements are reduced to a minimum.

While several particular embodiments of the present invention have been shown and described in detail, it should be understood that various obvious changes and modifications thereto may be made, and it is therefore intended in the following claims to include all such modifications and changes as may fall within the spirit and scope of this invention.

What is claimed is:

1. In a thread winding device of the type wherein a chucking spindle adapted for the reception of a removable bobbin carrier is turnably borne on an arm extending from the frame of the machine, and a plurality of clamping places are axially distributed about the outer circumference of the chucking spindle which have clamping elements disposed therein, said clamping elements being radially movable between an extended position in which the bobbin carrier is secured to the chucking spindle and a retracted position in which the bobbin carrier is released to freely slide over said chucking spindle, the improvement comprising:

an actuating means for moving said clamping elements into their retracted position by creating a thrust component which is axially parallel to the axis of said chucking spindle, said actuating means including an annular piston ring which is slidably mounted on and about said chucking spindle and will rotate therewith, a cylinder space into which compressed air is forced to actuate said annular piston ring, said cylinder spaced being arranged behind said piston ring and bounded by said chucking spindle outer circumference and a mantle shell which is arranged coaxially to said chucking spindle, and a compressed air feed channel leading from the frame of said device into a hollow space in the chucking spindle, said hollow space then being connected with said cylinder space by means of bores formed in said chucking spindle.

2. The thread winding device of claim 1 further comprising a means for automatically moving said clamping elements from their retracted position to their extended position in response to the torsional force created by the rotation of said chucking spindle relative to said bobbin carrier, said clamping elements being arranged in a common cage, and said actuating means cooperating with a winding groove so as to transform said axial thrust component into a rotary movement of said cage.

3. The thread winding device of claim 2 further comprising a torsion spring which engages said annular piston ring and which creates a force which normally brings said clamping elements into their extended position.

4. The thread winding device of claim 2, said clamping element cage being used as a thrust element, said cage thrust element being connected to said annular piston ring by axially parallel guide elements, and said winding groove being formed in the inner circumference of said annular piston ring which cooperates with a guide ball fixed to the outer circumference of said chucking spindle.

5. The thread winding device of claim 1 wherein said cylinder space is bounded at its axial ends by two oppositely disposed piston rings which actuate clamping elements located at two axially separated clamping places on said chucking spindle.

6. The thread winding device of claim 1, said clamping elements being arranged in a common cage, and said clamping element cage being used as a thrust element.

7. The thread winding device of claim 1 wherein the compressed air feed channel leads from the frame of said device into a distributor channel formed in a carrying arm of the chucking spindle, said distributor channel is connected to an annular gap formed between said carrying arm and its chucking spindle, which gap connects by means of said bores formed in said chucking spindle with said cylinder space, said annular gap being sealed at its end by an annular sealing means arranged coaxially to said carrying arm.

8. The thread winding device of claim 7 wherein said annular sealing means is a piston ring mounted for axial movement in said machine frame, the free end of said piston having an elastic sealing ring mounted thereon.

9. The thread winding device of claim 8 further comprising a choke mounted between said compressed air feed channel and said distributor channel, said annular sealing means being supplied with compressed air directly from said feed channel.

10. The thread winding device of claim 9 further comprising a central drive shaft extending through said carrying arm and joined at its free end with said chucking spindle, the compressed air distributor channel being sealed between said drive shaft and machine frame by sealing elements that are supplied with compressed air directly from said feed channel.

11. The thread winding device of claim 10 wherein said sealing elements comprise one or more O-rings which are seated in a groove formed in said machine frame about said drive shaft, said compressed air being supplied to said groove about the outer circumference of said O-rings.

12. The thread winding device of claim 7 wherein said compressed air is simultaneously supplied at substantially equal pressure from both sides of bearings upon which said chucking spindle rides upon said carrying arm.

* * * * *